United States Patent [19]

Lebret

[11] 4,444,424

[45] Apr. 24, 1984

[54] EXTENSIBLE HEAD FOR GRIPPING AND MODIFYING A GROUP OF OBJECTS

[75] Inventor: Gérard Lebret, Saint Lubin des Joncherets, France

[73] Assignee: E. P. Remy et Cie, Dreux, France

[21] Appl. No.: 318,257

[22] Filed: Nov. 4, 1981

[30] Foreign Application Priority Data

Dec. 9, 1980 [FR] France ..... 80 26121

[51] Int. Cl.[3] ..... B65G 47/26

[52] U.S. Cl. ..... 294/87 R; 198/434; 198/486; 294/65; 414/416

[58] Field of Search ..... 294/63 R, 64 R, 65, 294/86 R, 87 R, 87 A, 88; 53/247, 543, 544; 198/432, 434, 486; 414/416, 783

[56] References Cited

U.S. PATENT DOCUMENTS 3,939,993 2/1976 Lingl ..... 414/34
4,164,296 8/1979 Trees ..... 414/416
4,355,936 10/1982 Thomas et al. ..... 294/65 X

FOREIGN PATENT DOCUMENTS 1212855 3/1966 Fed. Rep. of Germany .
2529672 1/1977 Fed. Rep. of Germany .
1327084 4/1963 France .
1018500 1/1966 United Kingdom .
1019806 2/1966 United Kingdom ..... 414/416

*Primary Examiner*—Johnny D. Cherry
*Attorney, Agent, or Firm*—Kenyon & Kenyon

[57] ABSTRACT

An extensible head for seizing and reorienting a group of objects includes a frame to which is swivelled a member which drives swivelled first links to cause the translation of carriages on which are rotatably mounted supports for gripping members, these supports being connected to a plate by second links swivelled to the plate and to lugs provided on the supports.

2 Claims, 4 Drawing Figures

EXTENSIBLE HEAD FOR GRIPPING AND MODIFYING A GROUP OF OBJECTS

BACKGROUND OF THE INVENTION

The present invention relates generally to gripping heads and is more particularly concerned with an extensible head of variable configuration allowing the seizing and reorienting of groups of objects, such as for example bottles, flasks or the like having to be encased or uncased.

There are already known extensible heads allowing the gripping and modifying of a group of bottles. Such known heads comprise generally a plurality of seizing members mounted on a frame and adapted for example to uncase one or several groups of bottles to convey and thereafter release the same at the desired place, for example onto a conveyor.

However, no gripping heads have hitherto been proposed that are capable of reorienting the bottles of the group of bottles, after the latter has been seized in, for example, a carton or like cardboard box, or in a case.

Now reorientation of the bottles resulting from their rotation about a vertical axis may be particularly useful in the case of, for example, bottles or flasks of oval section. Indeed, in this particular case, the bottles have two transverse axes of different lengths, and it is desirable that, when the bottles are released onto a conveyor, the transverse axis of greater length be parallel to the direction of movement of the conveyor, otherwise the bottles or flasks may overturn. This is why the bottles seized by the gripping head often have to be reoriented before being put down on the conveyor. But such reorientation may also be necessary in the case of ordinary round-section bottles that have to be deposited on the conveyor in a definite angular position with respect to the longitudinal axis of the conveyor.

Such, therefore, is the problem set and solved by the present invention which provides an extensible head of particularly simple mechanical design allowing a group of seized bottles to be deposited according to a definite orientation.

SUMMARY OF THE INVENTION

To this end, and according to an essential characterizing feature of the invention, the proposed extensible head is characterized by a mechanism ensuring simultaneously the separation and rotation of a group of seized bottles round a vertical axis before releasing the same.

More specifically, the mechanism comprises a member swivelled to a frame and to which are coupled first links swivelled to movable carriages supporting gripping members located on either side of the member.

According to another characterizing feature of the invention, on each said carriage is swivelled a gripping member support to which is coupled a second link swivelled on the one hand to this support and on the other hand to a tray or the like connected to the frame.

It is thus understood that each second link swivelled to the support of the corresponding gripping members and to the tray connected to the head allows rotating a corresponding portion of the group of bottles round the axis of the respective gripping member under the action of the translation of the movable carriages caused by the rotation of the swivelling member to which the carriages are coupled.

According to another characterizing feature of the invention, each second link is swivelled to a lug or the like connected to the support of the gripping members.

As for the aforesaid swivelling member, it is provided at its upper portion with two diametrically opposite lugs, one of which is associated with drive means for rotating the said member, and it is also provided at its lower portion with two other, diametrically opposite lugs to which are swivelled the two first links, respectively, connected to the movable carriages on either side of the aforesaid tray.

Furthermore, to one of the lugs situated at the upper portion of the swivelling member is swivelled the rod of a fluid-operated actuator connected to the frame, whereas on the other lug is provided a travel limiting stop defining the end position of the moved apart carriages.

According to a preferred form of embodiment, the movable carriages are mounted slidingly on guide bars secured to the frame of the head.

The invention is also directed to a conveyor from which is or are suspended one or several seizing heads complying with the aforementioned characterizing features.

BRIEF DESCRIPTION OF THE DRAWINGS

Other advantages and characterizing features will appear more clearly from the following detailed description with reference to the appended drawings given solely by way of example and wherein.

DETAILED DESCRIPTION OF THE PREFERRED EMBODIMENT

Figure 1:
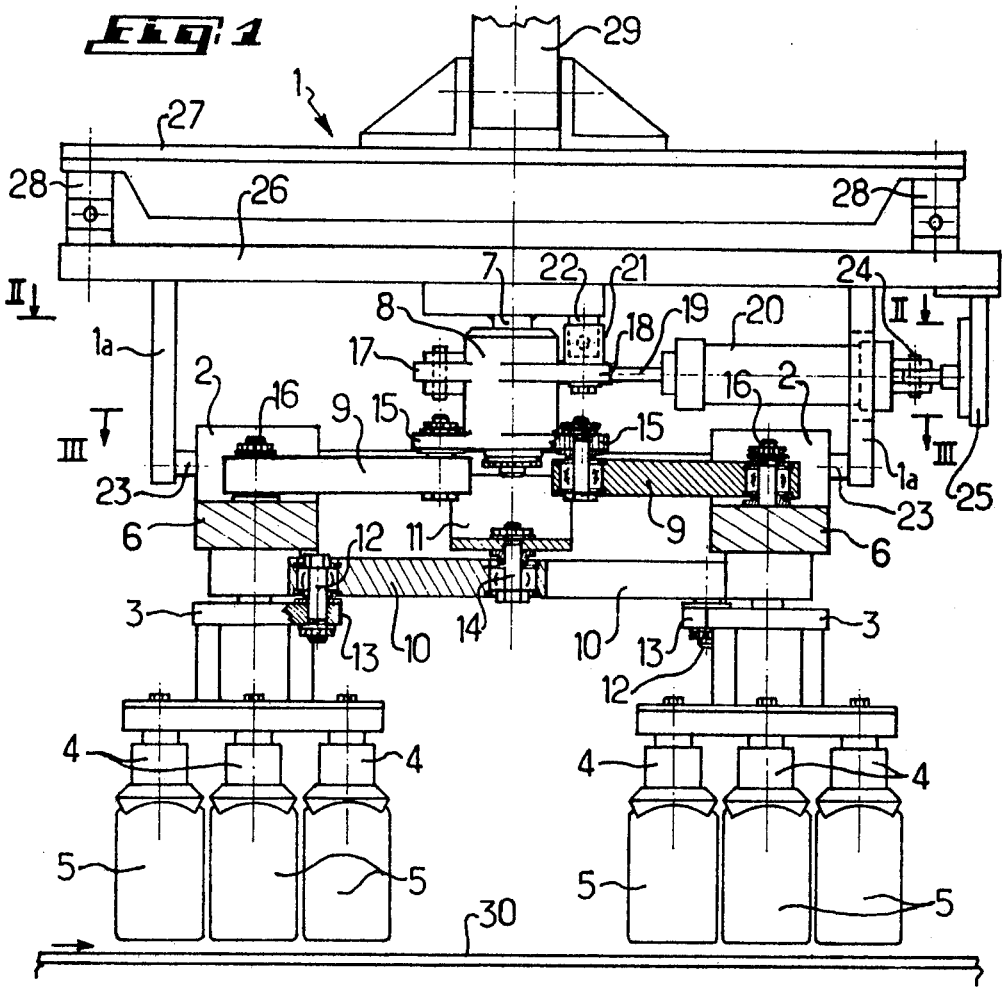
FIG. 1 is a diagrammatic elevational view, with parts broken away, of a seizing head carrying a certain number of seized and reoriented bottles ready to be deposited on a conveyor.

According to one embodiment and referring to the appended drawings, an extensible seizing head according to the invention comprises essentially a frame 1 from which are suspended two carriages 2 rotatably supporting supports 3 for members 4 for gripping bottles, flasks or the like 5, through the medium of an element 6.

To the frame 1 is swivelled a member 8 to which are coupled first links 9 swivelled to the carriages 2 to which are rotatably suspended the supports 3 of the gripping members 4.

To each gripping member support 3 is coupled a second link 10 swivelled on the one hand to the support and on the other hand to a tray, plate or the like 11 which is stationary and for example fixed to the frame 1 of the seizing head.

Figure 4:
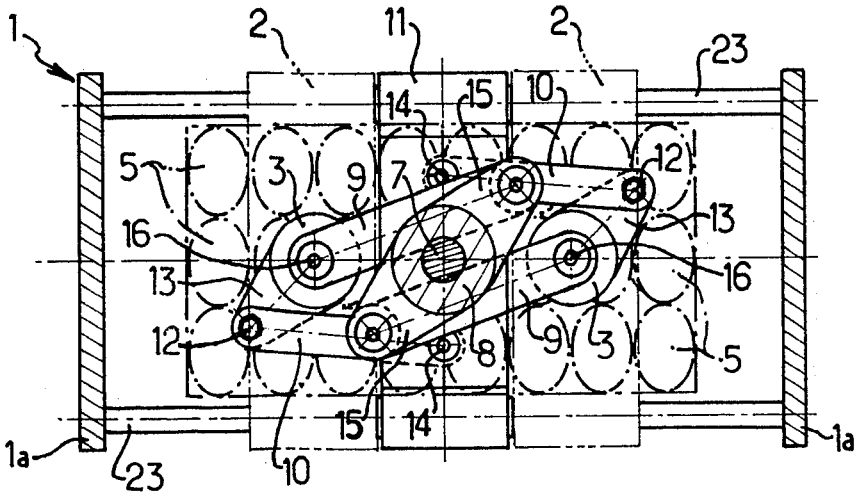
FIG. 4 is still another view upon III—III of FIG. 1, but showing the head in unspread or uncasing position.
Figure 3:
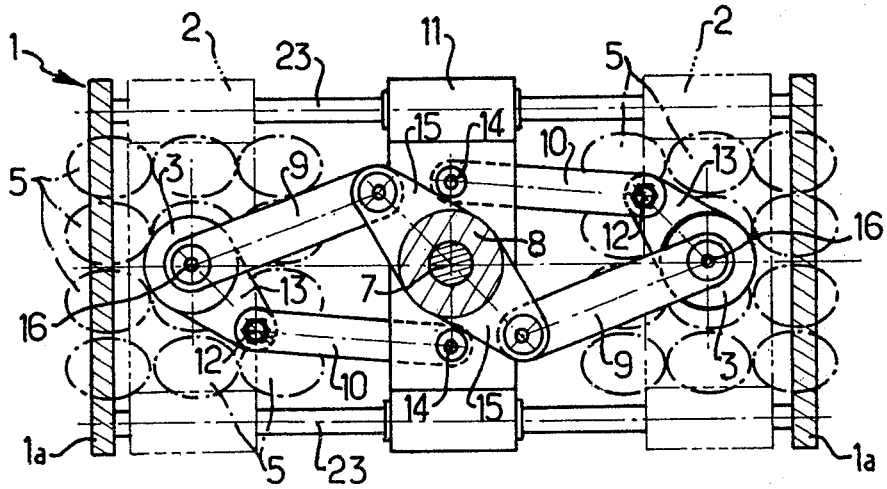
FIG. 3 is a sectional view substantially upon III—III of FIG. 1.

More specifically, each second link 10 is swivelled on the one hand at 12 to a lug or the like 13 forming part of the gripping member support 3 and on the other hand at 14 to the underside of the tray 11, as seen clearly in FIGS. 1, 3 and 4.

Figure 2:
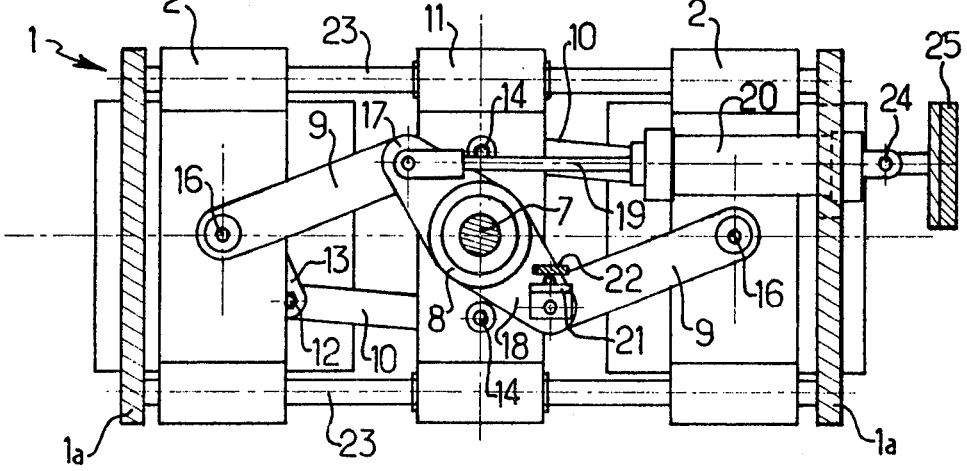
FIG. 2 is a sectional view upon II—II of FIG. 1.

The swivelled member 8 is provided at its lower portion with two diametrically opposite lugs 15 to each of which is swivelled one end of a corresponding first link 9, the other end of each of the links 9 being swivelled at 16 to the respective one of the carriages 2. As for the upper portion of the swivelled member 8, it is also provided with two diametrically opposite lugs 17, 18 which appear clearly in FIGS. 1 and 2, and which moreover are situated in the same vertical plane as the lugs 15 described previously. To the lug 17 is coupled the rod 19 of a fluid-operated actuator 20 connected to the head frame 1, as seen in FIGS. 1 and 2. To the lug 18 is secured a stop 21 which cooperates with a counter-stop 22 connected to the frame 1 of the head, so as to limit the translational travel of the carriages 2 when they reach their maximum moved apart position.

The carriages 2 are slidingly mounted on bars 23 secured to the frame 1 of the seizing head, which frame is provided to this end with side stays 1*a*. Furthermore, the body of the actuator 20 may be swivelled at 24 to a leg 25 connected to the frame 1.

As known per se, the frame 1 is essentially constituted by a supporting plate 26 underneath which the previously described member 8 swivels, which plate is removably assembled to an upper plate 27 through the medium of struts 28. On the upper plate 27 is secured a bar 29 for hitching and suspending the frame 1, i.e., the seizing head, from a conveyor which can thus drive several seizing heads of a same type, e.g. for continuously uncasing bottles arranged in cartons or like boxes.

The operation of the seizing head just described will now be set forth succinctly.

The starting position of the head will be assumed to be the one seen in FIG. 4 showing the carriages 2 in the gathered position, i.e., substantially contacting the plate 11. This position corresponds to the position of uncasing of a group of bottles located for example in a carton.

The bottles which, in this case, are oval as illustrated by way of example, are seized by the gripping members 4 and raised by the head to be conveyed to another place, e.g. on a conveyor shown diagrammatically at 30 in FIG. 1.

Before the bottles are deposited, however, the actuator 20 is operated to cause the member 8 to swivel, which, as seen clearly in FIG. 2, causes the simultaneous translation of the carriages 2 through the medium of the first links 9. Under the action of the translation of the carriages 2, the second links 10 exert a traction on their associated lugs 13, which, as is readily understood, results in the rotation of the supports 3 of the gripping members 4. Finally, as seen clearly in FIG. 3, the oval bottles 5 will have been rotated through 90° about the vertical axes of the carriages 2, so that the said bottles can be deposited on the conveyor 30 in such a manner that their transverse axis of greater length corresponds in direction to the movement of the conveyor 30 so that the bottles will be placed on the said conveyor in the best possible conditions of stability.

There is thus obtained, according to the invention, an extensible and rotatable seizing head allowing the bottles to be rotated and properly orientated before being deposited, by effecting a mere separation of the group of seized bottles which simultaneously ensures the rotation of the bottles.

The invention is by no means limited to the form of embodiment described and illustrated which has been given by way of example only.

Thus, the many swivelled connections of the links to the seizing head may be designed in any suitable manner without departing from the scope of the invention. The same applies to the number of gripping members associated with each carriage and the type of gripping members used.

The invention therefore comprises all technical equivalents to the means described as well as their combinations provided they are effected according to its gist and used within the scope of the protection claimed.

What is claimed is:

1. Apparatus for separating and reorienting a group of objects, the apparatus including a stationary frame, elongated guide means fixed to the frame, a plurality of carriages slidably mounted on the guide means, a plurality of gripping members carried by each carriage, a crank member pivotally mounted on the frame, a plurality of first links coupling the crank member to the carriages, and means for rotating the crank member between a first position at which the carriages are drawn together and a second position at which the carriages are spaced apart on said guide means, wherein the improvement comprises:

support means mounted on each carriage for rotation about a vertical axis, the respective plurality of gripping members being mounted on the support means of the carriage;

a plurality of second links, each having one end pivotally attached to a corresponding one of the support means and the other end pivotally connected to the frame such that translation of the carriages resulting from rotation of the crank member between the first position and the second position causes simultaneous rotation of each support means and its associated gripping members through a predetermined angle with respect to the corresponding carriage, each support means comprising a lug spaced from the axis of rotation of the support means, the said one end of the corresponding second link being swivelled on said lug, and said crank member being positioned between the carriages, the crank member comprising a first pair of diametrically opposed lugs, said means for rotating the crank member being coupled to one of said first lugs; and a second pair of diametrically opposed lugs, the other end of the second link associated with the carriage on one side of the crank member being swivelled on one of said second lugs, and the other end of the second link associated with the carriage on the other side of the crank member being swivelled on the other of said second lugs.

2. Apparatus according to claim 1 wherein the means for rotating the crank member between said first and second positions comprises a fluid-operated actuator mounted on the frame and having an extensible rod, the outer end of said rod being swivelled on the one of said first lugs, and the apparatus further comprises stop means on the other of said first lugs for contacting the frame when the crank arm reaches said second position.

* * * * *